US012778354B2

(12) United States Patent
Langlotz

(10) Patent No.: US 12,778,354 B2
(45) Date of Patent: Nov. 3, 2026

(54) HAND-OPERATED FOAM DISPENSER

(71) Applicant: Bode Chemie GmbH, Hamburg (DE)

(72) Inventor: Christian Langlotz, Hamburg (DE)

(73) Assignee: BODE CHEMIE GMBH, Hamburg (DE)

( * ) Notice: Subject to any disclaimer, the term of this patent is extended or adjusted under 35 U.S.C. 154(b) by 225 days.

(21) Appl. No.: 18/910,538

(22) Filed: Oct. 9, 2024

(65) Prior Publication Data

US 2025/0120554 A1 Apr. 17, 2025

(30) Foreign Application Priority Data

Oct. 11, 2023 (EP) ..... 23203048

(51) Int. Cl.

| | |
|---|---|
| ***B05B 11/00*** | (2023.01) |
| ***A47K 5/12*** | (2006.01) |
| ***A47K 5/122*** | (2006.01) |

(52) U.S. Cl.

CPC ..... *A47K 5/1201* (2013.01); *A47K 5/122* (2013.01)

(58) Field of Classification Search

CPC . B05B 11/046; B05B 11/0059; B05B 11/043; B05B 11/0037; B05B 11/0032; B05B 11/0062; B05B 11/0068; A47K 5/14; B01F 23/235

See application file for complete search history.

(56) References Cited

U.S. PATENT DOCUMENTS

| | | | | |
|---|---|---|---|---|
| 3,422,993 | A | 1/1969 | Boehm | |
| 6,394,315 | B1 * | 5/2002 | Banks | B05B 11/043 222/211 |
| 8,430,107 | B2 | 4/2013 | Huang | |
| 10,898,911 | B2 * | 1/2021 | Santagiuliana | B05B 11/1087 |
| 2002/0153389 | A1 * | 10/2002 | Creaghan | B05B 11/043 222/190 |
| 2004/0060945 | A1 * | 4/2004 | Cater | B05B 11/043 222/145.5 |
| 2005/0098581 | A1 | 5/2005 | Long | |

FOREIGN PATENT DOCUMENTS

| | | |
|---|---|---|
| EP | 4201532 A1 | 6/2023 |

OTHER PUBLICATIONS

Extended European Search Report issued by the European Patent Office on Mar. 18, 2024 in corresponding EP Patent Application No. 23203048.6, with English translation.

* cited by examiner

*Primary Examiner* — Paul R Durand
*Assistant Examiner* — Randall A Gruby
(74) *Attorney, Agent, or Firm* — Carter, DeLuca & Farrell LLP

(57) ABSTRACT

A foam dispenser comprises a plastic bottle made of a flexible plastic having a bottle opening, a closure cap which seals the bottle opening and has a dispensing opening for a foam. The foam dispenser further has a foam-generating device for foaming a solution, the device including a chamber having at least one wall and at least one porous body which is arranged in the chamber, wherein the foam-generating device is arranged in the closure cap and is at least partially formed by the closure cap. The foam dispenser can be manufactured cost-effectively, since it is composed of only a few components. The arrangement of the liquid inlet and the air inlet enables good emptying of residues. The foam-generating device also makes it possible to generate foam from alcoholic solutions.

21 Claims, 7 Drawing Sheets

HAND-OPERATED FOAM DISPENSER

CROSS-REFERENCE TO RELATED APPLICATIONS

The present application claims priority to application Ser. No. 23/203,048.6, filed in the European Patent Office on Oct. 11, 2023, which is expressly incorporated herein in its entirety by reference thereto.

FIELD OF THE INVENTION

The invention relates to a foam dispenser. This comprises a plastic bottle made of a flexible plastic with a bottle opening, a closure cap which seals the bottle opening and has a dispensing opening for a foam, a foam-generating device for foaming a solution, and a riser pipe which is arranged inside the plastic bottle.

BACKGROUND INFORMATION

Foam dispensers are used in the form of hand-operated or machine-operated dispensers for the foaming of products. Disinfectants or cleaning agents are often alcoholic solutions, since alcohols have a good microbiocidal effect, depending on the chain length. Such products are available as a solution, gel or foam. Alcoholic solutions are difficult to foam, as alcohol is a defoaming agent. To generate a foam from alcohol-based products, a foam-generating device is used which ensures that a foam is produced when liquid and air are mixed. The dispenser systems, especially in the case of mechanical dispensers, often consist of a plurality of sensitive components and are thus complex to manufacture and more expensive.

EP 4 201 532 A1 describes a hand-operated foam dispenser. This comprises a plastic bottle made of a flexible plastic having a bottle opening, a closure cap which seals the bottle opening and has a dispensing opening for a foam, a foam-generating device for foaming a solution, said device comprising a chamber having at least one wall, at least one inlet for air in a wall of the chamber, and at least one inlet for liquid in a wall of the chamber, and at least one porous body which is arranged in the chamber. The foam-generating device also makes it possible to generate foam from alcoholic solutions. However, the chamber having the inlet for air and the inlet for liquid must be produced with great precision so that a sufficient amount of air and liquid enters the chamber.

SUMMARY

Example embodiments of the invention to provide a hand-operated foam dispenser which overcomes disadvantages of conventional devices and, in particular, provides for the foaming of alcoholic solutions, can be produced cost-effectively and simply with a few components and allows the foam dispenser to be emptied as completely as possible.

Further example embodiments are described below.

The foam dispenser comprises

- a plastic bottle made of flexible plastic having a bottle opening,
- a closure cap which has a base which seals the bottle opening and has a dispensing opening for a foam,
- a foam-generating device for foaming a solution, comprising
  - a chamber having at least one wall and at least one porous body which is arranged in the chamber,

- at least one inlet for air and
  - at least one inlet for liquid,
  - wherein the foam-generating device is arranged in the closure cap and is at least partially formed by the closure cap,
- a riser pipe which is arranged inside the plastic bottle.

The foam-generating device has two cylinders, namely an inner cylinder and an outer cylinder, which are at least partially movably fitted into each other. The inner cylinder forms the chamber of the foam-generating device and the outer cylinder is held on the inner cylinder by a latching connection.

The term "cylinder" refers not only to hollow bodies with a circular base surface but also to hollow bodies with an oval base surface or with a round base surface that deviates from the ideal circle.

A porous body is understood to be at least one porous body, i.e. when a porous body is described, exactly one porous body or a plurality of porous bodies are comprised.

The foam dispenser is a manual foam dispenser which is hand-operated, i.e. in which the foam is generated by squeezing the bottle by hand. The plastic bottle is thus made of a flexible plastic so that it can be squeezed. The plastic bottle is preferably made of polypropylene (PP), polyethylene terephthalate (PET), low density polyethylene (LDPE), high density polyethylene (HDPE) or a mixture thereof, particularly preferably of HDPE and LDPE.

The outer cylinder is fitted onto the inner cylinder. In a preferred embodiment, the inner cylinder has an open end and a base; the outer cylinder also has an open end and a base. The base of the closure cap comprises the base of the inner cylinder. The outer cylinder is fitted onto the inner cylinder such that the open end of the inner cylinder faces the base of the outer cylinder and the open end of the outer cylinder faces the base of the closure cap.

Preferably, a first gap is formed between the open end of the outer cylinder and the base of the closure cap, a second gap is formed between the open end of the inner cylinder and the base of the outer cylinder, and a third gap is formed between the outer wall of the inner cylinder and the inner wall of the outer cylinder. The second gap is preferably arranged at the inlet for air. In this design, the first gap and the second gap are fluidly connected to each other by the third gap. The liquid (in the case of upside-down application) or the air (in the case of upright application) is fed into the foam-generating device through the first gap, the second gap and the third gap. In the case of the upside-down application, the liquid runs out of the bottle into the first gap when the plastic bottle is turned upside down. The user applies pressure to the bottle by hand, which creates excess pressure in the bottle. This causes the liquid to be conveyed from the first gap into the third gap. The liquid flows out of the third gap into the second gap, where it absorbs air and is transported into the chamber of the foam-generating device. The mixing of air and liquid in the porous bodies of the foam-generating device produces a foam which is discharged through the dispensing opening.

The third gap extends preferably along the entire circumference between the outer jacket surface of the inner cylinder and the inner jacket surface of the outer cylinder.

The first gap, for example, has a width of 0.1 mm to 0.75 mm, preferably 0.25 mm to 0.5 mm. The second as well as the third gap, for example, can each have a width of 0.25 mm to 2, preferably 0.5 mm to 1.5 mm.

At least one first latching element can be formed on the outside of the inner cylinder and at least one second latching element can be formed on the inside of the outer cylinder.

The latching elements can be formed as latching bulges, preferably as circumferential latching bulges, which extend around the entire cylinder circumference.

The third gap can extend through the latching connection.

In one embodiment, the latching connection has at least one latching bulge, wherein at least one channel is formed in the latching bulge, which channel connects the first gap and the third gap to each other. The channels can be formed, for example, as notches or incisions in the latching bulge at right angles to the circumferential direction. This causes more liquid to be transported from the first gap into the third gap.

The inlet for air can be formed in the base of the outer cylinder (upside-down application). In this case, the inlet for air is connected to the riser pipe and the air is transported through the riser pipe into the outer cylinder. The riser pipe could also be referred to as a ventilation pipe. Less preferably, the inlet for liquid can be arranged in the base of the outer cylinder (upright application). In this case, the inlet for liquid is connected to the riser pipe and the liquid is transported through the riser pipe into the outer cylinder. Depending on the application of the foam dispenser, the riser pipe can thus feed either air or liquid from the bottle into the foam-generating device.

As already mentioned, the foam dispenser can be used to generate foam either upside down, i.e. with the bottle turned upside down with the bottle base pointing upwards, or upright, with the bottle base pointing downwards. Upwards means vertically upwards towards the ceiling and downwards means vertically downwards towards the floor. The bottle can also be held at a slight angle during use, this is also included in upside down and upright.

The porous body can consist of an open-cell foam material. The open-cell foam material is preferably made of a polymer material, particularly preferably polyurethane (PUR) or acrylonitrile butadiene gum, also known as nitrile butadiene rubber (NBR).

The porous body can consist of or include a foam material which has a density of more than 0.03 g/cm$^3$, preferably of at least 0.035 g/cm$^3$, particularly preferably of at least 0.045 g/cm$^3$. Preferably, the porous body consists of or includes a foam material which has a density of at most 0.08 g/cm$^3$, preferably of at most 0.06 g/cm$^3$. The density refers to the density of the porous body placed in the chamber, which body can be uncompressed or compressed. In the case of an uncompressed porous body, the density of the uncompressed foam material in the chamber is specified. In the case of a compressed porous body, the density of the compressed foam material in the chamber is specified. The foam material in the chamber preferably has a density of more than 0.03 g/cm$^3$ and of at most 0.06 g/cm$^3$.

The porous body preferably consists of or includes a foam material which, in the uncompressed state, has a number of pores (=number of pores along a straight line per linear inch) of 50 to 130 pores/inch, preferably 60 to 100 pores/inch, for example around 70 pores/inch. The cell count is preferably determined microscopically.

The porous body preferably consists of or includes a foam material which, in the uncompressed state, has a pore size of 0.3 mm to 0.9 mm, measured according to ASTM D 3576-2004, preferably of 0.4 mm to 0.8 mm.

In a preferred embodiment, the porous body in the chamber is compressed by 10% to 50% of the volume of the uncompressed body, preferably by 15% to 50%, more preferably by 35% to 50% and most preferably by 35% to 40%. Compression increases the density of the foam material and can also change the shape of the pores of the foam material. Both the increase in density and the change in shape can have the effect that the solution can be foamed better.

The porous body is preferably fixed to the wall of the chamber, preferably by being clamped in its position in the chamber by contact with the wall. This ensures that the liquid has to flow through the pores of the foam material and prevents the porous body from floating on the liquid. The porous body is particularly preferably in full contact with the side walls of the chamber, so that the liquid must flow through the foam material when flowing through the chamber and no liquid can flow past the porous body. In this case, the porous body has the same cross-section as the chamber. The porous body preferably has a height which is at least half the length of the chamber, since a particularly good foam is produced if the liquid and air have a sufficient distance to travel in which they can mix in the pores of the foam material.

For example, the chamber can have a volume of 1 cm$^3$ to 5 cm$^3$, preferably 1 cm$^3$ to 3 cm$^3$ and particularly preferably 1 cm$^3$ to 2 cm$^3$. In particular, the chamber has a volume of 1.4 cm$^3$ to 2 cm$^3$. The porous body or the total number of porous bodies preferably fills the volume of the chamber to at least 80%, more preferably to at least 85%, even more preferably to at least 90%, particularly preferably to at least 95% and in particular substantially completely.

In one embodiment, the chamber is cylindrical and the porous body is cylindrical. If the chamber contains a plurality of porous bodies, these can, for example, be shaped as partial pieces of a cylinder, e.g. as two half cylinders or as pie pieces, which in total again have the shape of a cylinder.

When using a plurality of porous bodies, all porous bodies are preferably made of the same foam material. This has the advantage that the foam dispenser is easier and cheaper to manufacture, as there is no need to keep different materials in stock. In addition, the same mixing effect is achieved in all areas and a uniform foam is produced if the porous bodies are made of the same material.

The foam-generating device is designed as a double-walled hollow cylinder so that the liquid flow is directed through the double-walled hollow cylinder. In the upside-down application, the liquid first passes through the first gap into the outer of the two hollow cylinders, the third gap, and thus into the foam-free area and is then transported to the lower opening of the inner cylinder. This allows it to flow into the porous body from below so that the entire length of the porous body can be utilized for foam generation.

Since the foam material is fixed in the inner cylinder, the foam dispenser is easier to assemble, since, when the closure cap is screwed or clamped and when the outer cylinder is latched, the porous body is already in its position and does not have to be fixed during the screwing, clamping or latching process. It is also easy to replace the porous body by replacing only the inner cylinder or the closure cap connected to the inner cylinder.

The foam-generating device is at least partially formed by the closure cap. For this purpose, the inner cylinder can be formed in one piece with the closure cap. The inner cylinder is then an integral part of the closure cap and, for example, part of the same injection-molded part.

Since the foam dispenser is hand-operated, the bottle is preferably a size which is easy to hold with one hand. The bottle has a volume of 50 ml to 500 ml, for example. Preferably, the bottle has a volume of 100 ml to 250 ml, in particular 100 ml to 150 ml.

In a bottle with a volume of less than 500 ml, the inlet in the base of the outer cylinder preferably has a diameter of 1.0 mm to 2.5 mm, preferably 1.25 to 1.75 mm.

The foam dispenser can be designed as a disposable product for disposal after emptying the liquid or as a refillable reusable product. In a reusable product, both the alcoholic or non-alcoholic solution can be refillable and/or the porous body and/or the closure cap can be replaceable.

In one embodiment, the plastic bottle contains an alcoholic solution, preferably an alcoholic disinfectant.

The foam dispenser preferably contains an alcoholic or non-alcoholic mixture, which is typically a solution. The mixture contains at least one surfactant or a surface-active substance that acts as a foamable substance. The surfactant is preferably a silicone surfactant. Preferably, the surfactant or the surface-active substance is present in the mixture in an amount of 0.2 to 5% by weight, particularly preferably 0.2 to 2.5% by weight. The foam dispenser can be used for cleaning agents for skin and hands, for surfaces or instruments, or for disinfectants for skin or hands, for surfaces or instruments, for wound cleaning agents or wound disinfectants or for cosmetic agents, such as hair or skin cleaning agents or hair or skin care products.

The plastic bottle preferably contains an alcoholic solution, particularly preferably an alcoholic disinfectant. The alcoholic disinfectant preferably contains

- 70%-90% by weight of at least one monohydric alcohol with 1 to 4 carbon atoms, preferably ethanol,
- 9.5%-20% water by weight,
- 0.2%-2.5% by weight of at least one surfactant, preferably silicone surfactants, a surface-active substance or mixtures thereof,
- optionally 0%-2.5% by weight of foam stabilizers,
- 0.2%-2.5% by weight of excipients, for example skin care substances, refatting agents, moisturizers, pH regulators or mixtures thereof and
- optionally 0-5% by weight of other active ingredients, for example quaternary ammonium compounds (QAV), substances similar to QAV.

The plastic bottle can also contain a low-alcohol solution, such as a surface disinfectant. The low-alcohol solution preferably contains

- 10%-30% by weight of at least one monohydric alcohol with 1 to 4 carbon atoms,
- 69.8%-89.8% by weight of water,
- 0.2%-2.5% by weight of at least one surfactant, one surface-active substance or mixtures thereof,
- optionally 0%-2.5% by weight of foam stabilizers,
- 0%-5% by weight of excipients, for example skin care substances, refatting agents, moisturizers, pH regulators or mixtures thereof and
- optionally 0-2.5% by weight of other active ingredients, for example quaternary ammonium compounds (QAC), QAC-like substances.

Alternatively, the plastic bottle can contain an aqueous solution, such as a soap formulation. The aqueous solution preferably contains

- 0% alcohol by weight,
- 87.5%-99% by weight of water,
- 0.2%-5% by weight of at least one surfactant, a surface-active substance or mixtures thereof,
- optionally 0%-2.5% by weight of foam stabilizers,
- 0%-5% by weight of excipients, for example skin care substances, refatting agents, moisturizers, pH regulators or mixtures thereof and
- optionally 0-2.5% by weight of other active ingredients, for example quaternary ammonium compounds (QAC), QAC-like substances.

To foam an alcoholic composition, it must be mixed with foamable substances, i.e. surfactants or surface-active substances. Alcohols disrupt the surface tension and are also used as defoamers. The foaming of an alcohol-containing composition thus requires corresponding chemical excipients and additionally further physical/mechanical device(s), such as a foam dispenser which has a foam-generating device having at least one porous body in which liquid and air can be mixed to generate foam.

In the foam dispenser, the liquid supply to the foam-generating device is achieved in a simple manner. The foam-generating device has two movable cylinders fitted into each other, wherein in the preferred upside-down application of the foam dispenser, the liquid flows into the space between the two cylinders via connected gaps. The cylinders are preferably concentric to each other, i.e. both cylinders have the same central longitudinal axis.

The foam-generating device can be made of two injection-molded parts which are detachably connected to each other and have mutual play, i.e. there is no press fit. This creates a double-walled cylinder with a circumferential gap between the two components. The liquid is transported through this gap to the inlet for air and mixed with the air in the foam material inside with a nozzle effect. The mixing of air and liquid in the foam material creates a foam. Assembly is simplified by the detachable connection, i.e. the movable connection of the two cylinders. Due to the play of the detachably connected injection-molded parts of the foam-generating device, there is no need for precision components that are expensive to produce. In an upside-down application, the advantage also includes the fact that the first gap is located at the lowest point of the foam dispenser and even small quantities of liquid can still be transported through the first gap into the foam-generating device. This optimizes the emptying of residues.

The foam dispenser can be produced cost-effectively, since it is composed of only a few components and the components can be produced, for example, by an injection molding method without reworking. The arrangement of the liquid inlet and the air inlet enables good emptying of residues. The components of the foam dispenser, in particular the closure cap and the foam-generating device, could also be produced by milling or 3D printing as an alternative to the preferred injection molding method.

A method for foaming an alcoholic solution, preferably an alcoholic disinfectant, includes i. providing a foam dispenser, as described herein, wherein the foam dispenser contains the alcoholic solution, ii. manually squeezing the bottle of the foam dispenser so that an alcoholic foam can be obtained.

Measuring Methods

Density

To determine the density of the uncompressed foam, first the outer dimensions of a foam material sample are measured and the volume is calculated from the outer dimensions. The weight of the foam material sample is also determined and the density is calculated using the formula density=weight/volume. The density of the uncompressed foam material is thus determined in accordance with the ISO 845 ($g/cm^3$) or ASTM D 3574-11A ($lb/ft^3$) standards. If the porous body in the chamber of the foam dispenser is compressed, the density increases accordingly by the degree of compression. To calculate the density, reference is made in the present case to the volume that the porous body has in the chamber when in the compressed state.

Number of Pores

The number of pores is determined microscopically. For this purpose, a straight line is made along one surface of the foam material and the number of pores along this line is counted over a distance of 1 inch.

Pore Size

The pore size is determined in accordance with ASTM D 3576-2004. For this purpose, a thin layer of foam material of a defined size is cut and placed in a special projector. The projector projects the sample together with a reference line. The length of the reference line is specified in millimeters. The number of cells which are intersected by the reference line is counted. The mean pore size is calculated from the length of the reference line and the number of pores.

DETAILED DESCRIPTION

Figure 1:
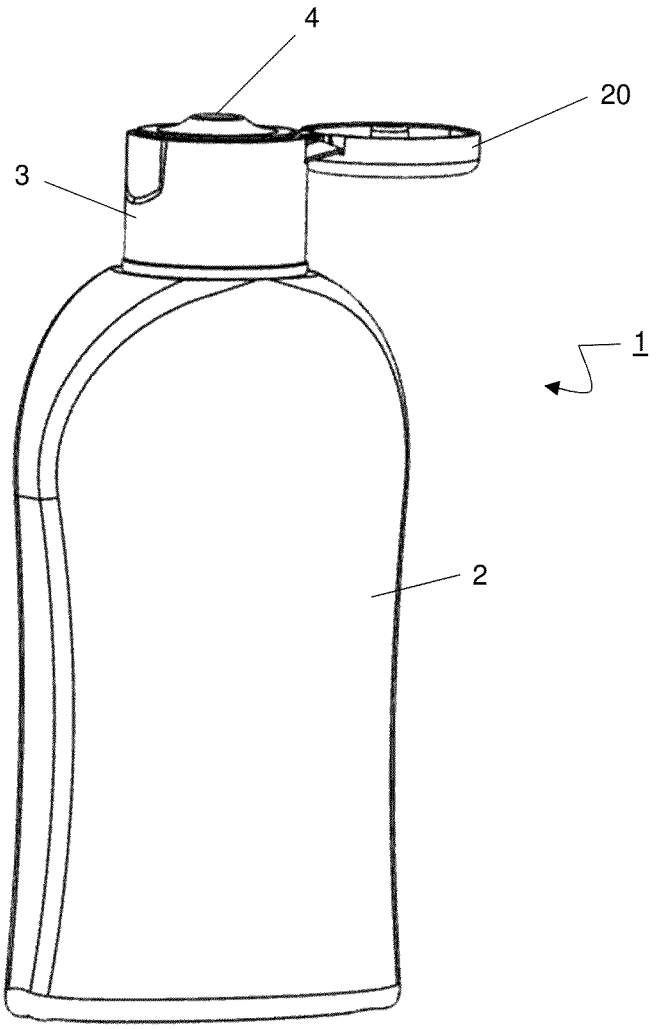
FIG. 1 shows an embodiment of a foam dispenser in a perspective view.

FIG. 1 shows a preferred embodiment of a foam dispenser. The foam dispenser 1 comprises a bottle 2 with a closure cap 3 screwed onto the bottle. The closure cap is formed here as a hinged cap with a hinged lid 20. A dispensing opening 4 is arranged on the top side of the closure cap 3. A foam-generating device is located inside the closure cap.

Figure 2A:
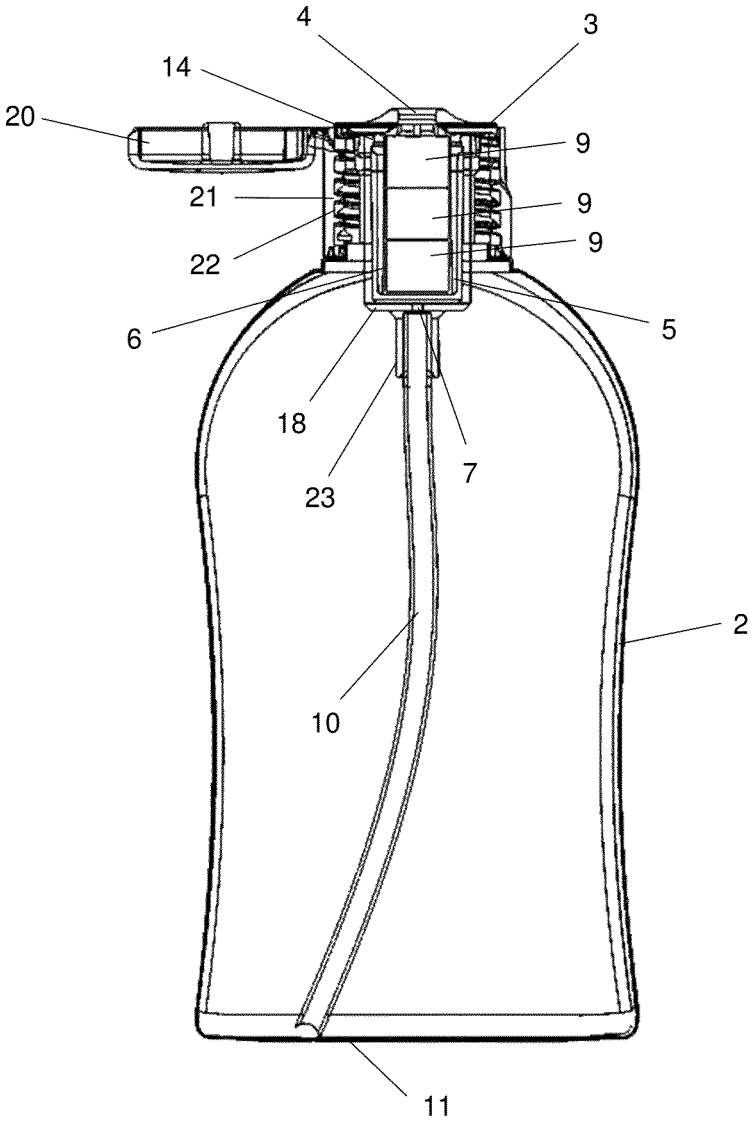
FIGS. 2*a* and *b* show a sectional view of a foam dispenser.
Figure 2B:
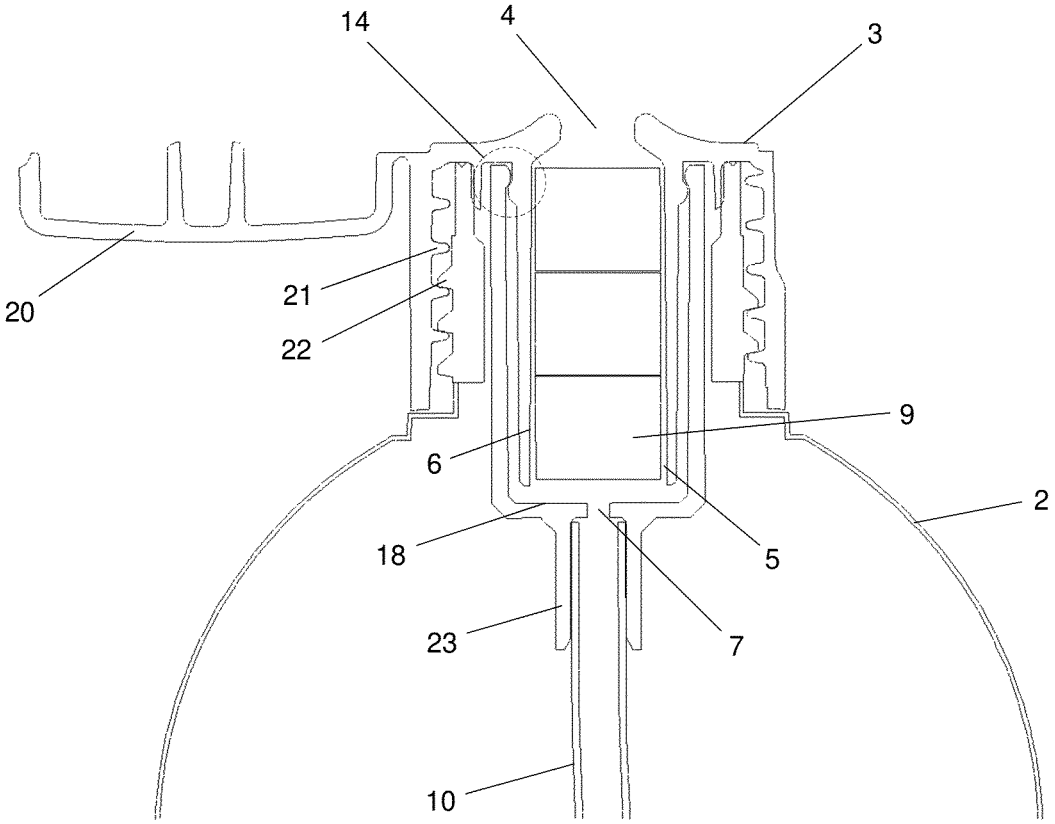

FIG. 2*a* shows a sectional view of a preferred embodiment of a foam dispenser 1. The foam dispenser 1 is preferably designed to generate foam in an upside-down position. The foam dispenser comprises a bottle 2, which is closed with a closure cap 3. The closure cap 3 is designed as a screw cap with an internal thread 21 which is screwed to the external thread 22 on the neck of the bottle. A chamber 5 is arranged in the closure cap 3, in which chamber three porous bodies 9 are placed one above the other. The porous bodies 9 lie against the wall 6 of the chamber 5 so that the liquid must flow through the porous bodies 9 to the dispensing opening 4. There is an inlet 7 on the underside of the chamber 5, which inlet is connected to a riser pipe 10. The riser pipe 10 extends from the inlet 7 at the base 18 to the base of the bottle 11. The chamber is designed as a single-walled hollow cylinder, which on its top side is connected to the closure cap 3. The top side of the chamber 5 is directed towards the dispensing opening 4, with which it is fluidly connected. FIG. 2*b* shows a simplified sectional view of the upper half of the foam dispenser 1 shown in FIG. 2*a*.

Figure 3:
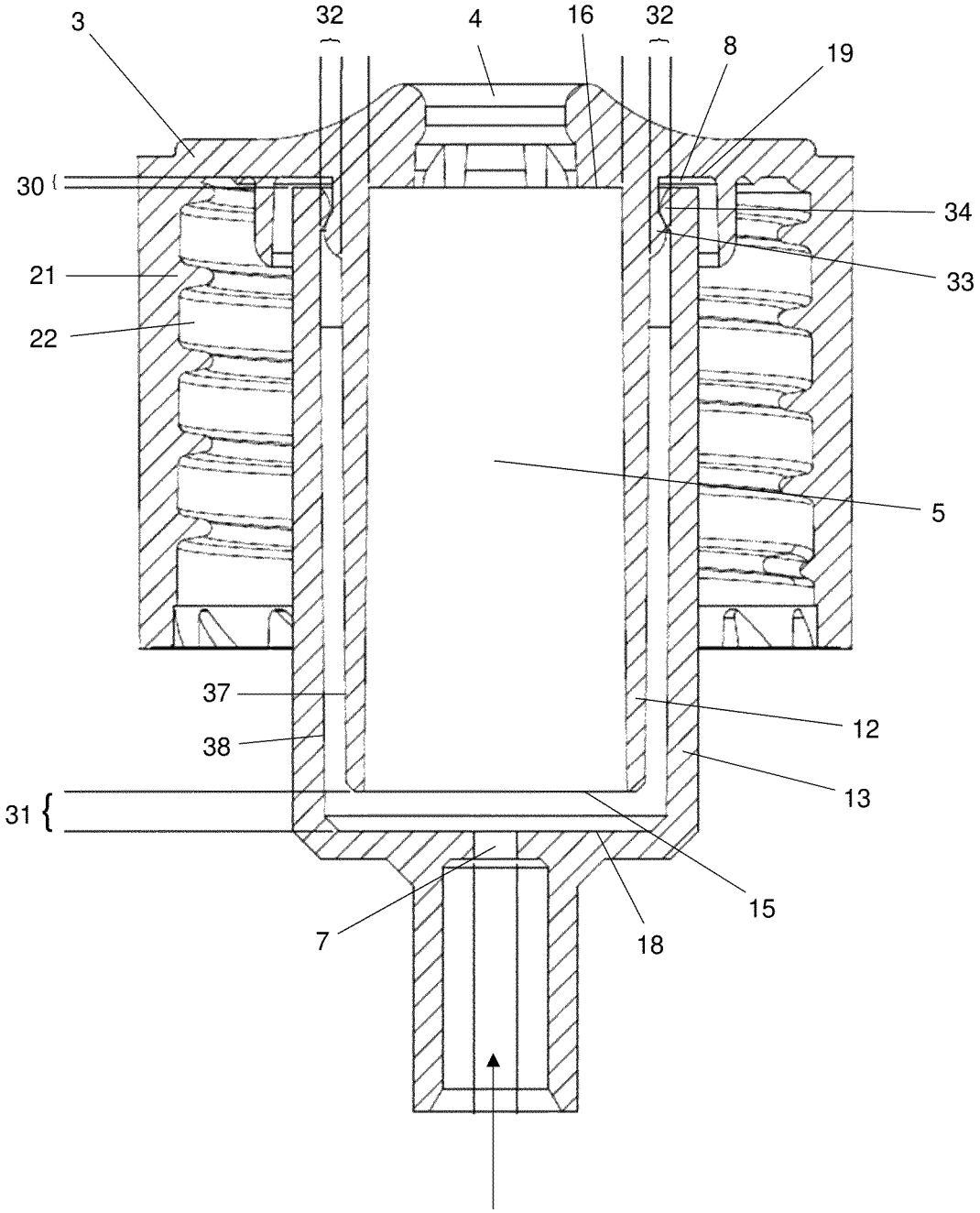
FIG. 3 shows an enlarged section of the sectional view shown in FIG. 2*a*.

FIG. 3 shows an enlarged section of the sectional view of the area of the closure cap 3 shown in FIG. 2. The porous bodies in the chamber are not shown in FIG. 3. The inner cylinder 12, which is part of the closure cap 3, has an open end 15 and a base 16. The outer cylinder 13 has an open end 17 and a base 18. The inlet 7 for air is arranged in the base 18. The outer cylinder 13 is connected at its underside to a holder 23 for the riser pipe 10. The base 19 of the closure cap 3 also comprises the base 16 of the inner cylinder, which forms the base of the chamber 5. The outer cylinder 13 is fitted onto the inner cylinder 12 so that the open end 15 of the inner cylinder 12 faces the base 18 of the outer cylinder 13 and the open end 17 of the outer cylinder 13 faces the base 19 of the closure cap. To fasten the outer cylinder to the closure cap 3, the foam dispenser has a latching connection 14 (highlighted with the dotted circle in FIG. 2*b*). The latching connection 14 consists of two latching bulges. A first latching element 33 in the form of a latching bulge is formed on the outside 37 of the inner cylinder 12. A second latching element 34, also in the form of a latching bulge, is formed on the inside 38 of the outer cylinder 13.

A first gap 30 is located between the base 19 of the closure cap and the open end 17 of the outer cylinder. A third gap 32 is visible between the inner wall 38 of the outer cylinder 13, which is fitted onto the inner cylinder and latched, and the outer wall 37 of the inner cylinder 12. When the plastic bottle is turned upside down, the liquid runs out of the bottle into the first gap. Pressure exerted by the user on the bottle creates an overpressure in the bottle and the liquid is conveyed from the first gap 30 into the third gap 32. A second gap 31 is located between the open end 15 of the inner cylinder and the base 18 of the outer cylinder 13. The second gap 31 is arranged here at the inlet 7 for air. The first gap 30 and the second gap 31 are fluidly connected to each other by the third gap 32. The liquid flows out of the third gap 32 into the second gap 31, where it absorbs air and is transported into the chamber 5 and the porous bodies located there. In the porous body, foam is formed from the air/liquid mixture, which foam is discharged through the dispensing opening 4. The arrow in FIG. 3 indicates the path by which air enters into the foam-generating device.

Figure 4:
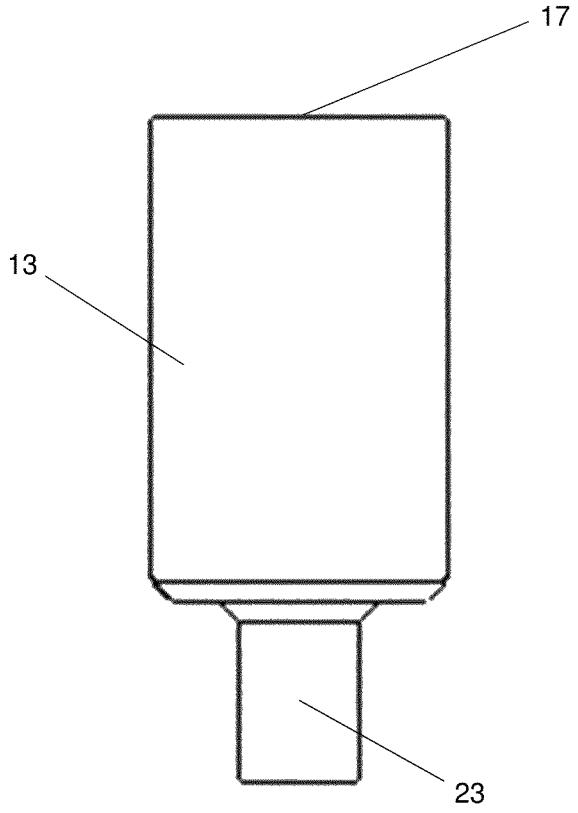
FIG. 4 shows a top view of an outer cylinder of a foam dispenser.

FIG. 4 shows a top view of an outer cylinder 13 of a foam dispenser. The outer cylinder has an open end 17 and a base. A holder 23 for the riser pipe is arranged on the underside of the outer cylinder 13.

Figure 5:
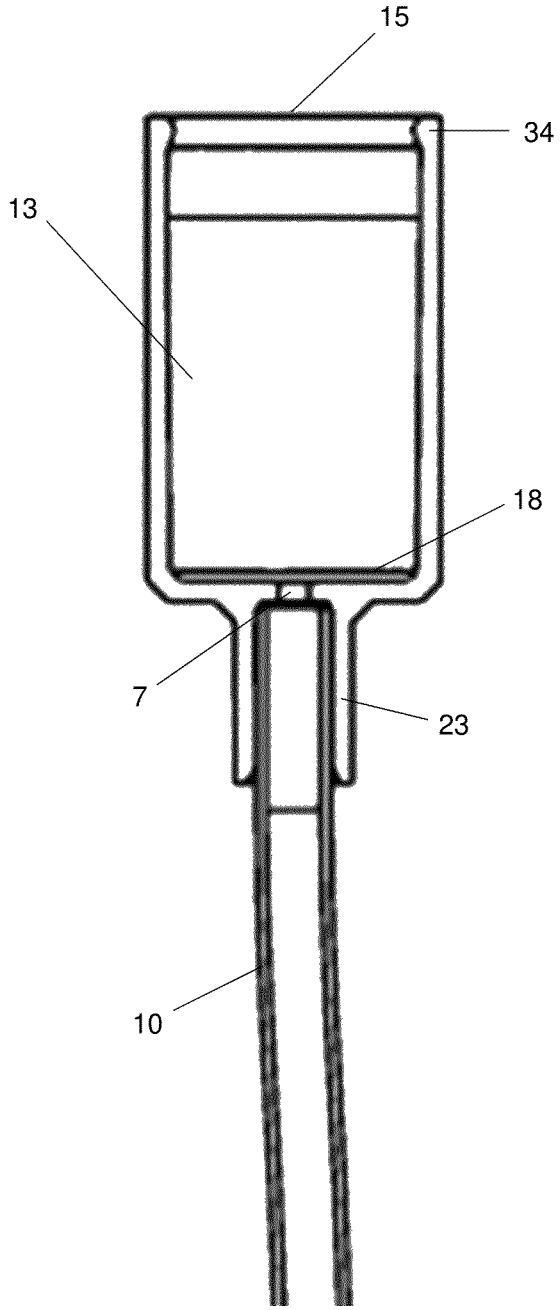
FIG. 5 shows a sectional view of the outer cylinder shown in FIG. 4 with a riser pipe.

FIG. 5 shows a sectional view of the outer cylinder 13 shown in FIG. 4 with a riser pipe 10. In the region of the open end, a latching element 34 can be seen, which is formed as a circumferential latching bulge. The outer cylinder 13 has a base 18. An opening which represents an inlet can be seen in the center of the base 18. Preferably, in an upside-down application, the opening is an inlet 7 for air. However, in the case of upright application of the foam dispenser, the opening can also be used as an inlet 8 for liquid.

Figure 6:
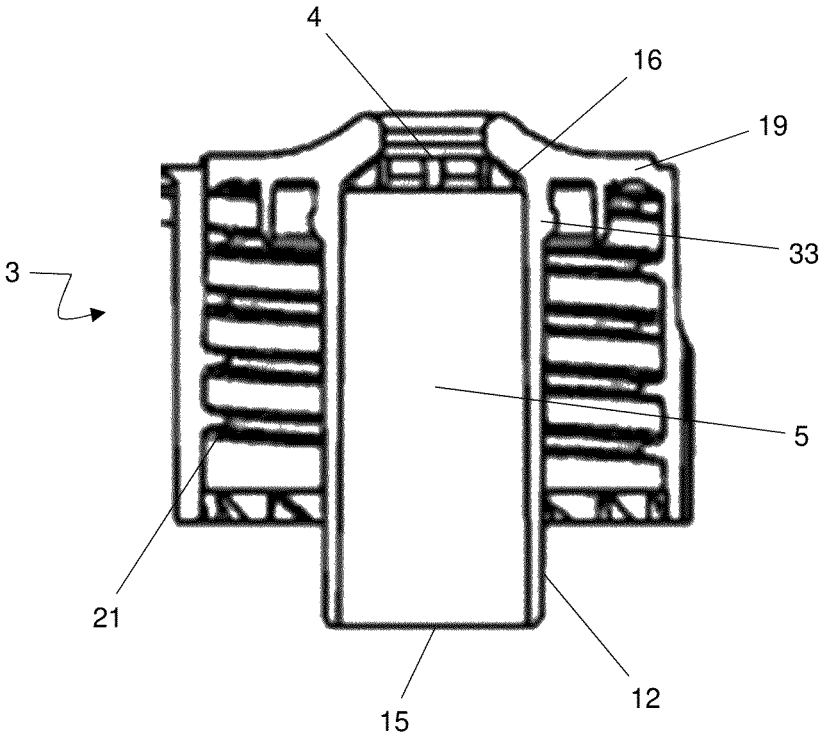
FIG. 6 shows a sectional view of a closure cap with an inner cylinder.

FIG. 6 shows a sectional view of a closure cap 3 with an inner cylinder (without lid). The inner cylinder 12 is an integral part of the closure cap 3 and is formed in one piece therewith. The interior of the inner cylinder forms the chamber 5 in which the porous bodies are pressed. The base 19 of the closure cap comprises the base 16 of the inner cylinder. The dispensing opening 4 is arranged in the center of the base 16 of the inner cylinder. A first latching element 33 in the form of a latching bulge is arranged on the outside 37 of the inner cylinder 12.

| Reference numeral list | |
|---|---|
| Foam dispenser | 1 |
| Plastic bottle | 2 |
| Closure cap | 3 |
| Dispensing opening | 4 |
| Chamber | 5 |
| Wall of the chamber | 6 |
| Inlet for air | 7 |
| Inlet for liquid | 8 |
| Porous body | 9 |
| Riser pipe | 10 |
| Bottle base | 11 |

-continued

| Reference numeral list | |
|---|---|
| Inner cylinder | 12 |
| Outer cylinder | 13 |
| Latching connection | 14 |
| Open end of inner cylinder | 15 |
| Base of inner cylinder | 16 |
| Open end of outer cylinder | 17 |
| Base of outer cylinder | 18 |
| Base of closure cap | 19 |
| Lid | 20 |
| Internal thread | 21 |
| External thread | 22 |
| Riser pipe holder | 23 |
| First gap | 30 |
| Second gap | 31 |
| Third gap | 32 |
| First latching element | 33 |
| Second latching element | 34 |
| Outer wall of inner cylinder | 37 |
| Inner wall of outer cylinder | 38 |

The invention claimed is:

1. A foam dispenser, comprising a plastic bottle made of flexible plastic having a bottle opening, a closure cap which has a base which seals the bottle opening and has a dispensing opening for a foam, a foam-generating device for foaming a solution, comprising a chamber having at least one wall and at least one porous body which is arranged in the chamber, at least one inlet for air and at least one inlet for liquid, wherein the foam-generating device is arranged in the closure cap and is at least partially formed by the closure cap, a riser pipe which is arranged inside the plastic bottle, the foam-generating device has two cylinders, including an inner cylinder and an outer cylinder, which are at least partially movably fitted into each other, wherein the inner cylinder forms the chamber, wherein the outer cylinder is held on the inner cylinder by a latching connection, wherein the inner cylinder has an open end and a base, the outer cylinder has an open end and a base, wherein the base of the closure cap comprises the base of the inner cylinder and wherein the outer cylinder is fitted onto the inner cylinder such that the open end of the inner cylinder faces the base of the outer cylinder and the open end of the outer cylinder faces the base of the closure cap, and wherein a first gap is formed between the open end of the outer cylinder and the base of the closure cap, a second gap is formed between the open end of the inner cylinder and the base of the outer cylinder, wherein the second gap is arranged at the inlet for air, and in that the first gap and the second gap are fluidly connected to each other by a third gap, wherein the third gap is formed between the outer wall of the inner cylinder and the inner wall of the outer cylinder, and extends through the latching connection.

2. The foam dispenser according to claim 1, wherein at least one first latching element is formed on an outside of the inner cylinder and at least one second latching element is formed on an inside of the outer cylinder.

3. The foam dispenser according to claim 1, wherein the third gap extends along an entire circumference between an outer jacket surface of the inner cylinder and an inner jacket surface of the outer cylinder.

4. The foam dispenser according to claim 1, wherein the inlet for air is formed in a base of the outer cylinder.

5. The foam dispenser according to claim 1, wherein the porous body consists of an open-cell foam material.

6. The foam dispenser according to claim 1, wherein the porous body consists of a foam material which has a density of more than 0.03 g/cm$^3$, at least 0.035 g/cm$^3$, or at least 0.045 g/cm$^3$.

7. The foam dispenser according to claim 1, wherein the porous body consists of a foam material which has a density of at most 0.08 g/cm$^3$ or at most 0.06 g/cm$^3$.

8. The foam dispenser according to claim 1, wherein the porous body consists of a foam material which, in an uncompressed state, has a number of pores of 50 to 130 pores/inch, 60 to 100 pores/inch, or about 70 pores/inch.

9. The foam dispenser according to claim 1, wherein the porous body consists of a foam material which, in an uncompressed state, has a pore size of 0.3 mm to 0.9 mm, measured according to ASTM D 3576-2004, or 0.4 mm to 0.8 mm.

10. The foam dispenser according to claim 1, wherein the porous body is compressed in the chamber by 10% to 50%, by 15% to 50%, by 35% to 50%, or by 35% to 40%.

11. A foam dispenser, comprising a plastic bottle made of flexible plastic having a bottle opening, a closure cap which has a base which seals the bottle opening and has a dispensing opening for a foam, a foam-generating device for foaming a solution, comprising a chamber having at least one wall and at least one porous body which is arranged in the chamber, at least one inlet for air and at least one inlet for liquid, wherein the foam-generating device is arranged in the closure cap and is at least partially formed by the closure cap, a riser pipe which is arranged inside the plastic bottle, the foam-generating device has two cylinders, including an inner cylinder and an outer cylinder, which are at least partially movably fitted into each other, wherein the inner cylinder forms the chamber, wherein the outer cylinder is held on the inner cylinder by a latching connection having at least one latching bulge, wherein at least one channel is formed in the latching bulge, which channel connects the first gap and the third gap to each other, wherein the inner cylinder has an open end and a base, the outer cylinder has an open end and a base, wherein the base of the closure cap comprises the base of the inner cylinder and wherein the outer cylinder is fitted onto the inner cylinder such that the open end of the inner cylinder faces the base of the outer cylinder and the open end of the outer cylinder faces the base of the closure cap, and wherein a first gap is formed between the open end of the outer cylinder and the base of the closure cap, a second gap is formed between the open end of the inner cylinder and the base of the outer cylinder, wherein the second gap is arranged at the inlet for air, and in that the first gap and the second gap are fluidly connected to each other by a third gap, wherein the third gap is formed between the outer wall of the inner cylinder and the inner wall of the outer cylinder.

12. The foam dispenser according to claim 11, wherein the inner cylinder has an open end and a base, the outer cylinder has an open end and a base, wherein the base of the closure cap comprises the base of the inner cylinder and wherein the outer cylinder is fitted onto the inner cylinder such that the open end of the inner cylinder faces the base of the outer cylinder and wherein the open end of the outer cylinder faces the base of the closure cap.

13. The foam dispenser according to claim 11, wherein at least one first latching element is formed on an outside of the inner cylinder and at least one second latching element is formed on an inside of the outer cylinder.

14. The foam dispenser according to claim 11, wherein the third gap extends along an entire circumference between an outer jacket surface of the inner cylinder and an inner jacket surface of the outer cylinder.

15. The foam dispenser according to claim 11, wherein the inlet for air is formed in a base of the outer cylinder.

16. The foam dispenser according to claim 11, wherein the porous body consists of an open-cell foam material.

17. The foam dispenser according to claim 11, wherein the porous body consists of a foam material which has a density of more than 0.03 g/cm$^3$, at least 0.035 g/cm$^3$, or at least 0.045 g/cm$^3$.

18. The foam dispenser according to claim 11, wherein the porous body consists of a foam material which has a density of at most 0.08 g/cm$^3$ or at most 0.06 g/cm$^3$.

19. The foam dispenser according to claim 11, wherein the porous body consists of a foam material which, in an uncompressed state, has a number of pores of 50 to 130 pores/inch, 60 to 100 pores/inch, or about 70 pores/inch.

20. A method for foaming an alcoholic solution, comprising the steps of i. providing a foam dispenser according to claim 1, wherein the foam dispenser contains the alcoholic solution, ii. manually squeezing the plastic bottle of the foam dispenser so that an alcoholic foam can be obtained.

21. The method according to claim 20, wherein the alcoholic solution includes an alcoholic disinfectant.

* * * * *